United States Patent [19]

Hammerer

[11] Patent Number: 4,899,804

[45] Date of Patent: Feb. 13, 1990

[54] PLUNGER TIP FOR COLD CHAMBER DIE CAST MACHINE

[76] Inventor: Norman L. Hammerer, 3231 W. Southway Dr., Franklin, Wis. 53132

[21] Appl. No.: 312,445

[22] Filed: Feb. 21, 1989

[51] Int. Cl.[4] ..... B22D 17/08; B22D 17/20

[52] U.S. Cl. ..... 164/312; 164/314

[58] Field of Search ..... 164/312, 314

[56] References Cited

U.S. PATENT DOCUMENTS

| | | | |
|---|---|---|---|
| 2,932,865 | 4/1960 | Bauer | 164/312 X |
| 3,092,880 | 6/1963 | Morton . | |
| 3,300,822 | 1/1967 | Thompson | 164/312 |
| 3,613,768 | 10/1971 | Awano et al. | 164/312 X |
| 3,618,831 | 11/1971 | Goodwin et al. | 164/312 X |
| 3,670,805 | 6/1972 | Weiers | 164/312 |
| 3,960,201 | 6/1976 | Portalier | 164/312 |
| 4,154,288 | 5/1979 | Borgen | 164/314 |
| 4,598,762 | 7/1986 | Glas | 164/312 |
| 4,635,851 | 1/1987 | Zecman . | |
| 4,667,729 | 5/1987 | Zecman | 164/314 X |
| 4,732,206 | 3/1988 | Hildreth et al. | 164/312 |

FOREIGN PATENT DOCUMENTS

| | | | |
|---|---|---|---|
| 2904883 | 7/1979 | Fed. Rep. of Germany | 164/312 |
| 55-1950 | 1/1980 | Japan | 164/312 |
| 55-156662 | 12/1980 | Japan | 164/312 |
| 57-68257 | 4/1982 | Japan | 164/312 |
| 1225680 | 4/1986 | U.S.S.R. | 164/312 |
| 1266652 | 10/1986 | U.S.S.R. | 164/312 |

*Primary Examiner*—Richard K. Seidel
*Assistant Examiner*—J. Reed Batten, Jr.
*Attorney, Agent, or Firm*—Fuller, Puerner & Hohenfeld

[57] ABSTRACT

The plunger tip includes a closed, one-piece wear ring, the outside diameter of which is sized nominally to the bore of the shot cylinder. A cap is provided, a portion of which having an outside diameter which just fits inside the wear ring. The cap is elongated and has a tip end and an attachment end. An annular shoulder portion is located near the tip end, which shoulder portion is larger than the diameter of the rest of the cap and butts against the wear ring. A collar is slid onto the cap so as to capture the wear ring between itself and the shoulder of the cap. The cap includes flats at the attachment end, and the collar includes flats on an inside surface thereof which match with the flats of the cap for preventing relative rotation between the cap and the collar. The cap is provided with threads formed on its attachment end, the plunger shaft having matching threads by which the plunger shaft is connected to the cap. The collar has two or more flats on its outside surface for cooperating with a wrench to allow the collar, and hence the cap, to be rotated with respect to the plunger shaft in attaching the shaft and the cap together. The collar includes openingss for allowing the escape of any leaked cooling fluid through side walls thereof.

15 Claims, 1 Drawing Sheet

PLUNGER TIP FOR COLD CHAMBER DIE CAST MACHINE

BACKGROUND OF THE INVENTION

This invention relates to die cast machines in which a plunger is employed to force molten metal to be cast through a shot cylinder (cold chamber) and into a mold, and in particular to providing longer lives, reduced costs and lower maintenance for plunger tips for plungers in such machines.

As is well known in the art of die casting, molten metal is forced into a die cavity under pressure exerted by a plunger. The tip of the plunger, being subjected to high pressures, friction and contact with molten metal, is subject to substantial wear. Prior plunger tips have been one-piece affairs, simply removably attached to the end of the plunger shaft.

In hot chamber die cast machines, the plunger tips generally have a number of split rings for providing sealing, much as shown in Thompson, U.S. Pat. No. 3,300,822, except that prior to Thompson the split rings were rectangular in cross section. The Thompson patent, on the other hand, shows a plunger tip having a number of split rings, the cross section of which is not strictly rectangular but having a chamfered surface toward the molten metal, ostensibly to provide self-lubrication of the rings against the interior wall of the shot cylinder. Hot chamber die cast apparatus, such as disclosed in Thompson, however, are not properly applicable to cold chamber machines, because the problems encountered are substantially different. For instance, passage of molten metal beyond the sealing rings is a less severe problem in hot chamber die casting since the metal will remain molten. In cold chamber die casting, however, such leakage would cause "canning", freezing any such split rings and preventing their flexure, thereby increasing friction and wear, rather than decreasing it.

The referenced Thompson patent proposes the solution of lubricating the tip, in hot chamber die casting. It has been found by the inventor of the present invention, though, that in cold chamber die casting lubrication is not as great a problem as leakage of the molten metal past a portion of the rings, causing excessive wear of the rings and of the tip itself, requiring premature replacement of the entire tip. Further, in considering pressures that become very high in the cold chamber casting process, splits in the rings can be another source of leakage of molten metal and premature wear. Such leaked molten metal freezes around the ring, preventing it from flexing, and thus preventing it from providing proper seal.

The patent issued to Morton, U.S. Pat. No. 3,092,880, shows a three piece plunger tip where a tip body is screwed onto the plunger rod, a sealing ring is interlocked into the tip body, and a plunger cap is press fitted into the sealing ring. The disadvantage of this assembly is that the cap is in effect merely press fitted to the plunger rod. Since the cap must at one step of the casting cycle disclosed in that patent exert a vacuum on the molten metal, or more commonly be pulled free from solidified metal adhered to the cap, it could conceivably pull free, resulting in substantial down time in thereafter removing the cap from the apparatus or from the hardened metal. If the press fit is indeed made quite secure to avoid this problem, replacement of the sealing ring while allowing re-use of the cap is very difficult, and it is generally required to replace the cap along with the sealing ring, which is wasteful.

A Japanese patent, 57-068257, shows a plunger tip wherein a cap is threadedly attached to a body, with a number of split rings therebetween. The body is in turn threadedly attached to a plunger rod. A thermal boundary between the parts effects cooling. However, the statements above relating to split rings apply to this device. Further, threading the cap onto the body requires the application of a wrench to the cap, and any resulting damage to the cap, or any flats provided for that purpose which are exposed to the molten metal, will also be a point of potential sticking for the solidifying metal in front of the tip, again causing premature wear and unnecessarily shortening the life of the tip assembly.

This invention relates to improvements over the apparatus described above and to solutions to the problems raised thereby.

SUMMARY OF THE INVENTION

The invention includes a plunger tip for attachment to a plunger shaft in a shot cylinder of a die casting machine. According to the invention, the plunger tip includes a closed, one-piece wear ring, the outside diameter of which is sized nominally to the bore of the shot cylinder. A cap is provided, having an outside diameter which just fits inside the wear ring. The cap is elongated and has a tip end and an attachment end. An annular shoulder portion of the cap is located near the tip end, which shoulder portion is larger than the diameter of the rest of the cap and butts against the wear ring. The cap further includes attachment means at its attachment end for attaching the cap to the plunger shaft. The invention further includes a collar, which is slid onto the cap so as to capture the wear ring between itself and the shoulder of the cap. The collar has means which cooperate with corresponding means on the cap to prevent relative rotation between the cap and the collar. Alternatively, the collar and the wear ring may be formed integrally together.

The cap includes flats at the attachment end, and the collar includes flats on an inside surface thereof which match with the flats of the cap for preventing relative rotation between the cap and the collar. The attachment means for attaching the cap to the plunger shaft includes threads formed on the attachment end of the cap, the plunger shaft having matching threads by which the plunger shaft is connected to the cap, and a shoulder portion which butts against the collar. The collar has two or more flats on its outside surface for cooperating with a wrench to allow the collar, and hence the cap, to be rotated with respect to the plunger shaft in attaching them together. The wear ring has a front surface which is substantially normal to the inside surface of the shot cylinder.

The cap is cooled by cooling fluid circulated therein from the plunger shaft. Wear on the wear ring is reduced because the ring is separated from the cooling fluid by the inside of the cap, which thus provides thermal break. Further, only a small portion of the surface of the ring is exposed to the molten metal. Hence the ring is not exposed to both heating and cooling effects at the same time, resulting in reduced expansion and contraction due to temperature changes. The collar includes means for allowing the escape of any leaked cooling fluid through side walls thereof if necessary.

Finally, the length of the wear ring is short with respect to the diameter of the ring. This relationship has the effect of allowing for more non-concentricity between the center line of the shaft and the center line of the shot cylinder, resulting in longer wear and less binding than with conventional length wear members.

Other objects and advantages of the invention will become apparent hereinafter.

DESCRIPTION OF THE PREFERRED EMBODIMENTS

Figure 1:
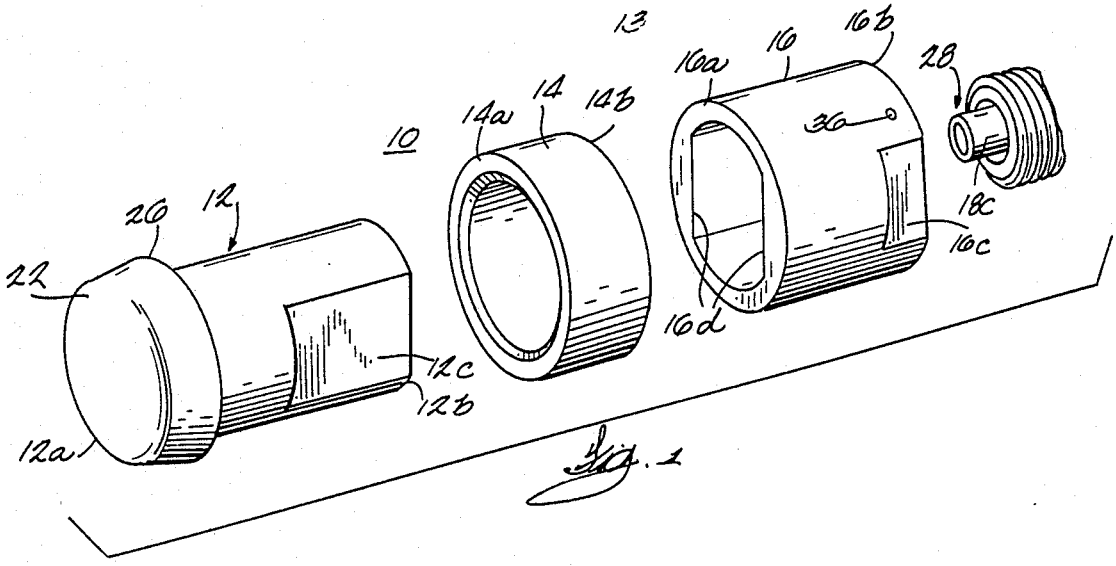
FIG. 1 is an exploded isometric view of a plunger tip and a portion of a plunger shaft, wherein the plunger tip is constructed according to a preferred embodiment of the invention.
Figure 2:
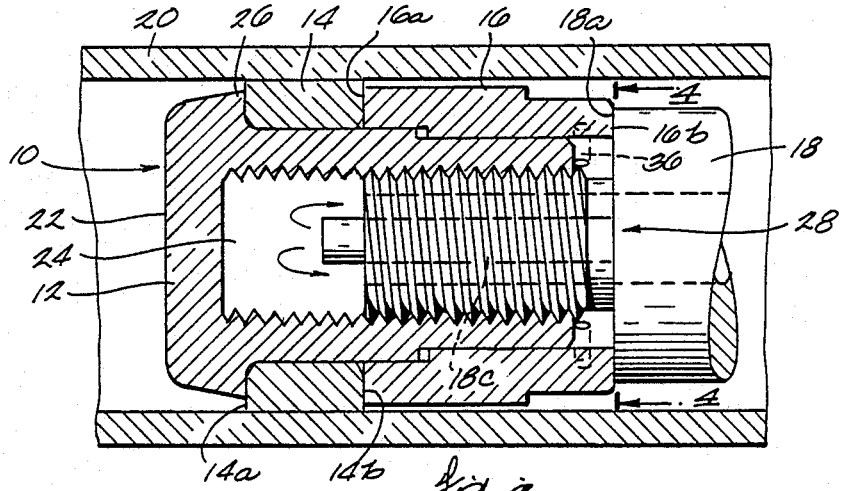
FIG. 2 is a cross sectional view of a shot cylinder showing the details of assembly of the plunger tip and shaft shown in FIG. 1.

Referring now to FIGS. 1 and 2, there is shown a plunger tip 10 which includes a cap 12, and a bearing means 13, comprising a wear ring 14 and a collar 16, all assembled to the end of a plunger shaft 18 and inserted into a shot cylinder 20, as set forth in detail below. While the bearing means 13 is referred to throughout this description as a separate wear ring 14 and collar 16, such could just as easily comprise a single part, having a wear ring portion at its leading edge which faces the cap 12 and a collar portion at its trailing edge which faces the plunger shaft 18.

The wear ring 14 is a closed, one-piece ring, having an outside diameter sized so as to just slidably fit inside the shot cylinder 20, as shown best in FIG. 2. The front surface 14*a* of the wear ring 14 is substantially normal to the inside surface of the shot cylinder 20. The majority of the length of the cap 12 has an outside diameter which just slidably fits inside the wear ring 14. The cap 12 is elongated and generally cylindrical in shape. The cap 12 has a tip 22 at the front end 12*a* thereof and an axial bore 24 beginning at the opposite or attachment end 12*b* and continuing most of the length of the cap. An enlarged annular shoulder portion 26 is formed about the cap 12, just behind the tip 22. This shoulder 26 has an outside diameter which is smaller than the outside diameter of the wear ring 14, but larger than the inside diameter thereof, so that when the cap is inserted into the wear ring, it stops at the shoulder, with the shoulder butting against the front surface 14*a* of the wear ring. Wear ring 14 is constructed of a material which is harder and less thermally conductive than the material of cap 12, so that the cap absorbs more of the heat from the molten metal and so that the wear ring stands up to the wear better. Cap 12 is substantially longer than the wear ring 14, so that when the shoulder 26 butts against wear ring front surface 14*a*, the cap projects substantially beyond the opposite surface 14*b* of the wear ring.

The collar 16 has an inside diameter substantially the same as that of the wear ring 14, that is, sized to just slidably fit over the outside diameter of the cap 12. The outside diameter of the collar 16 is not critical, and may be substantially the same as or smaller than the shoulder 26, that is, smaller than the outside diameter of the wear ring 14, but of course larger than the inside diameter thereof, so that the front surface 16*a* of the collar butts against the rear surface 14*b* of the wear ring.

Attachment means 28 are provided for removably attaching the cap 12 and the plunger shaft 18 together. Again, the outside diameter of the plunger shaft 18 is not critical, but is required to fit easily into the shot cylinder 20. The shaft 18 is provided with a shoulder portion 18*a*, which butts against the trailing face 16*b* of the collar 16. By this attachment, then, the wear ring 14 and the collar 16 are trapped between the shoulder 26 of the cap 12 and the shoulder 18*a* of the plunger shaft 18.

In the embodiment shown in FIGS. 1 and 2, the attachment means 28 includes a threaded extension portion 18*b* projecting outward beyond the shoulder portion 18*a* of the plunger shaft 18. Further, the inside of the axial bore 24 of the cap 12 is tapped to match the threads of the extension 18*b*. Hence the cap 12 is attached to the plunger shaft 18 by threading onto the extension 18*b*.

Means are provided for holding the cap 12 with respect to the plunger shaft 18 in order to provide the proper torque of tightening therebetween. However, it is not desirable to use a wrench directly on the cap 12, as any damage caused by such usage would be the first area attacked by the molten metal encountered by the cap during the injection casting process, and will also be a point of potential sticking for the solidifying metal in front of the tip, again causing premature wear and unnecessarily shortening the life of the tip assembly. Hence the means provided in the present invention for holding the cap 12 are in fact means for holding the collar 16, in combination with means for preventing relative rotational motion between the collar and the cap. In the preferred embodiment, the means for holding the collar 16 include a plurality of flats 16*c* formed in the outside surface of the collar 16. Also in the preferred embodiment, the means for preventing relative rotational motion between the collar 16 and the cap 12 include a plurality of flats 12*c* formed on the outside surface of the cap, in combination with corresponding flats 16*d* formed on the inside surface of the collar. Thus when a torque is applied to turn the collar 16, by means of applying a wrench to the flats 16*c*, the collar is rotated, in turn causing the cap 12 to rotate. The plunger shaft 18 may be held by an suitable means since it does not ordinarily come in contact with molten metal during the casting process, so that any minor damage or marring thereon caused by a wrench would be irrelevant.

Figure 3:
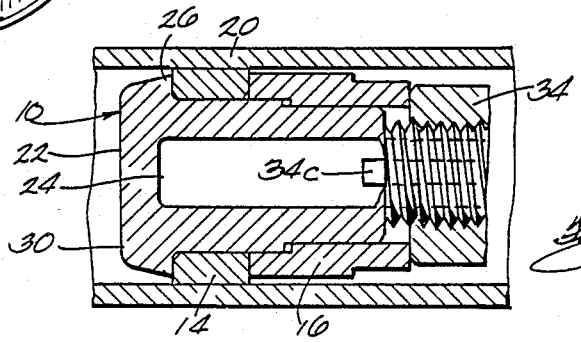
FIG. 3 is a view, partially in cross section, of a plunger tip and plunger shaft, wherein the plunger tip is constructed according to another preferred embodiment of the invention.

An alternative means of attachment of the cap 12 to the plunger shaft can be seen by reference to FIG. 3. The embodiment there shown includes a cap 30 which is similar to the cap 12 shown in FIGS. 1 and 2, except that the attachment end 30*a* includes a threaded extension 32 extending the length of the cap 30. This embodiment is designed for a plunger shaft 34 of a different type than the shaft 18 shown in FIGS. 1 and 2. In the plunger shaft 34, threads are provided on the inside. Hence the extension 32 is threaded into the end of the shaft 34, rather than other way around as was the case with the embodiment shown in FIGS. 1 and 2.

Figure 4:
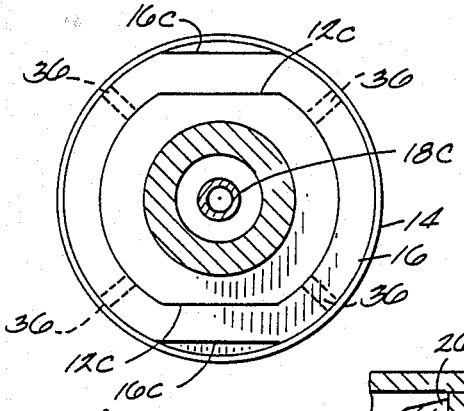
FIG. 4 is a cross sectional view of FIG. 2, taken along line 4—4.
Figure 5:
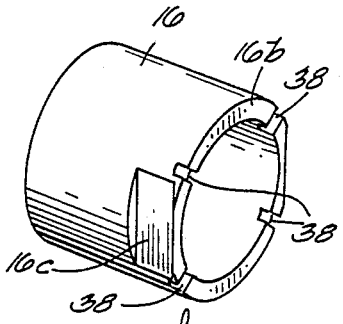
FIG. 5 is an isometric view of a collar constructed according to one embodiment of the invention.

Ordinarily, in a die cast operation, cooling fluid is provided to the plunger tip. In the present invention, this cooling fluid is provided via the plunger shaft 18 or 34 being hollow, and carrying a tube 18*c* and 34*c* respectively, opening into the axial bore 24 of the cap 12 or 30. The fluid returns in the shaft 18 or 34 itself. In the case of either shaft 18 or 34, means must be provided in the collar to allow escape of any leaked fluid. In the embodiment shown in FIGS. 1, 2 and 4, the escape means provided are cylindrical openings 36 formed in the collar 16 parallel to the plane of the trailing face 16*b* of the collar. Alternatively, as shown in FIG. 5, the escape means could be cuts 38 formed directly in the trailing face 16*b*.

Finally, as previously indicated, the length of the wear ring 14 is short with respect to the outside diameter of the ring. This relationship has the effect of making it easier to insert the ring into shot cylinder 20, since insertion is possible with greater misalignment than is possible with prior art caps.

Hence the invention provides a plunger tip with a substantially longer life than those provided in the prior art, for a number of reasons. First, the wear ring provides a better seal between itself and the shot cylinder than those of the prior art. In addition, the wear ring is not cooled directly by the cooling fluid, and has very little surface area exposed to the molten metal. This results in less expansion and contraction of the ring, substantially reducing metal fatigue in the ring. The cap constructed according to the invention, on the other hand, has more effective cooling surface area, and therefore disburses heat better. Further, the invention provides means for attaching the plunger tip to the plunger shaft without having to apply a wrench to any portion thereof that is exposed to the molten metal. This results in substantially longer life for the cap itself, since the molten metal is less likely to stick when it solidifies. Even when the wear ring does wear out, it is significantly easier and cheaper to replace that part alone rather than the entire plunger tip, as provided in the structure of the present invention. Finally, lubrication of the tip is facilitated by the fact that only a small portion of the wear surface, that is, the length of the wear ring, need protrude into the shot cylinder before injection of the molten metal.

While the apparatus hereinbefore described is effectively adapted to fulfill the aforesaid objects, it is to be understood that the invention is not intended to be limited to the specific preferred embodiment of a plunger tip for cold chamber die cast machines as set forth above. Rather, it is to be taken as including all reasonable equivalents within the scope of the following claims.

I claim:

1. A die casting machine having in combination a shot cylinder having a bore, and a plunger fitted in said bore, said plunger having a tip for displacing molten die casting metal from said shot cylinder, said tip being attached to an end of a plunger shaft, said plunger shaft end being threaded, said tip comprising:

A. a cap, having:

(1) an outside diameter substantially smaller than said bore of said shot cylinder, (2) a tip end and an attachment end, (3) an annular shoulder portion, larger in diameter than the rest of said cap but still smaller than said bore of said shot cylinder, said shoulder portion located nearer said tip end, and (4) threaded attachment means at said attachment end for threadedly attaching said cap to said threaded end of said plunger shaft;

B. a wear ring, the inside diameter of which just fits over said cap between said shoulder and said attachment end of said cap, and the outside diameter of which is sized nominally to said bore of said shot cylinder;

C. a collar, slidably fitted onto said cap so as to capture said wear ring between itself and said shoulder, and having means which cooperate with corresponding means on said cap to prevent relative rotation between said cap and itself; and D. means for holding said collar with respect to said plunger shaft so as to permit said cap to be threaded tightly onto said plunger shaft without requiring application of a wrench directly to said cap.

2. A die casting machine as recited in claim 1 wherein a portion of said cap nearer said attachment end includes flats, and wherein the inside surface of said collar includes flats which match with the flats of said cap to prevent relative rotation between said cap and said collar.

3. A die casting machine as recited in claim 1 wherein said means for holding said collar includes flats on the outside surface of said collar cooperating with a wrench to allow said collar, and hence said cap, to be rotated with respect to said plunger shaft.

4. A die casting machine as recited in claim 1 wherein said collar includes means for allowing the escape of any leaked cooling fluid through side walls of said collar.

5. A die casting machine as recited in claim 1 wherein said wear ring is a closed, one-piece ring, having a front surface which is substantially normal to the inside surface of said shot cylinder.

6. A die casting machine as recited in claim 1 wherein said wear ring is constructed of a material which is harder and less thermally conductive than the material of said cap.

7. A plunger tip for attachment to a threaded end of a plunger shaft in a shot cylinder of a die casting machine, said plunger tip comprising:

a closed wear ring, the outside diameter of which is sized nominally to said bore of said shot cylinder;

a cap, having an outside diameter which just fits inside said wear ring, having a tip end and an attachment end, having an annular shoulder portion located near said tip end, larger than the diameter of the rest of said cap and butting against said wear ring, and threaded attachment means at said attachment end for threadedly attaching said cap to said threaded end of said plunger shaft;

a collar, slid onto said cap so as to capture said wear ring between itself and said shoulder, and having means which cooperate with corresponding means on said cap to prevent relative rotation between said cap and itself; and means for holding said collar with respect to said plunger shaft, so as to permit said cap to be threaded tightly onto said threaded end of said plunger shaft without requiring application of a wrench directly to said cap.

8. A plunger tip as recited in claim 7 wherein said cap includes flats at said attachment end, and wherein said collar includes flats on an inside surface thereof which match with the flats of said cap for preventing relative rotation between said cap and said collar.

9. A plunger tip as recited in claim 7 wherein said means for holding said collar comprises two or more flats on the outside surface of said collar for cooperating with a wrench to allow said collar, and hence said cap, to be rotated with respect to said plunger shaft.

10. A plunger tip as recited in claim 7 wherein said collar includes means for allowing the escape of any leaked cooling fluid through side walls thereof.

11. A plunger tip as recited in claim 7 wherein said wear ring is a single closed, one-piece ring having a front surface which is substantially normal to the inside surface of said shot cylinder.

12. A plunger tip for attachment to a plunger shaft in a shot cylinder of a die casting machine, said plunger shaft having a threaded end, said plunger tip comprising:

a cap, having a tip end and an attachment end, having an annular shoulder portion located near said tip end, larger than the diameter of the rest of said cap, and threaded attachment means at said attachment end for attaching said cap to said threaded end of said plunger shaft; and tubular bearing means, having an inside diameter which just fits over said cap, and having an area of largest outside diameter which is sized nominally to said bore of said shot cylinder, the forward end of which area of largest diameter butts against said shoulder of said cap, said bearing means being slid onto said cap, and having means which cooperate with corresponding means on said cap to prevent relative rotation between said cap and itself;

said bearing means including means for holding said bearing means with respect to said plunger shaft so as to permit said cap to be threaded tightly onto said threaded end of said plunger shaft without requiring application of a wrench directly to said cap.

13. A plunger tip as recited in claim 12 wherein said bearing means comprises a wear ring and a collar, said wear ring having an outside diameter which is sized nominally to said bore of said shot cylinder, and said collar being slid onto said cap so as to capture said wear ring between itself and said shoulder of said cap, and having a smaller outside diameter than said wear ring.

14. A plunger tip as recited in claim 12 wherein said cap includes flats at said attachment end, and wherein said bearing means includes flats on an inside surface thereof which match with the flats of said cap for preventing relative rotation between said cap and said bearing means.

15. A plunger as recited in claim 12 wherein said bearing means includes an area of smaller outside diameter spaced apart from said cap, and said means for holding said bearing means comprises two or more flats on the outside surface of said area of smaller diameter for cooperating with a wrench to allow said bearing means, and hence said cap, to be rotated with respect to said plunger shaft.

* * * * *